US005360519A

United States Patent [19]

Scarano

[11] Patent Number: 5,360,519

[45] Date of Patent: Nov. 1, 1994

[54] SUPPORT APPARATUS FOR PAPERMAKING MACHINE ROTATING FELT SUCTION PIPES

[75] Inventor: Robert V. Scarano, Glen Falls, N.Y.

[73] Assignee: Thermo Fibertek Inc., Waltham, Mass.

[21] Appl. No.: 10,415

[22] Filed: Jan. 28, 1993

[51] Int. Cl.[5] ..... D21F 1/48

[52] U.S. Cl. ..... 162/363; 162/199

[58] Field of Search ..... 162/199, 278, 279, 363, 162/364; 210/406, 416.1; 492/12

[56] References Cited

U.S. PATENT DOCUMENTS

| | | | |
|---|---|---|---|
| 631,106 | 8/1899 | Crocker et al. | 162/358 |
| 1,205,672 | 11/1916 | Seybold | 162/368 |
| 1,434,318 | 10/1922 | Schwartz . | |
| 1,438,286 | 12/1922 | Ayers . | |
| 1,501,179 | 7/1924 | Peacock . | |
| 1,635,317 | 7/1927 | Feeney . | |
| 1,840,102 | 1/1932 | Jespersen | 162/279 |
| 3,091,563 | 5/1963 | Meyer | 162/358 |
| 3,309,263 | 3/1967 | Grobe . | |
| 3,526,017 | 9/1970 | Kleimola . | |
| 3,630,838 | 12/1971 | Bryand et al. | 162/368 |
| 3,687,730 | 8/1972 | Murphy et al. . | |
| 3,836,428 | 9/1974 | McConaughy . | |
| 3,900,364 | 8/1975 | Nelson et al. . | |
| 3,943,035 | 3/1976 | Stotz et al. . | |
| 4,011,131 | 3/1977 | Nicholson . | |
| 4,036,683 | 7/1977 | Biondetti . | |
| 4,046,623 | 9/1977 | Schmid . | |
| 4,111,746 | 9/1978 | Biondetti . | |
| 4,232,435 | 11/1980 | Eriksen . | |
| 4,278,497 | 7/1981 | Mellen . | |
| 4,338,193 | 7/1982 | Lautrette et al. . | |
| 4,504,359 | 3/1985 | Ericksen . | |
| 4,547,266 | 10/1985 | Keller . | |
| 4,608,125 | 8/1986 | Autio . | |
| 4,657,634 | 4/1987 | Autio . | |
| 4,657,637 | 4/1987 | Lindstrom . | |
| 4,671,876 | 6/1987 | Schipper . | |
| 4,882,011 | 11/1989 | Eskelinen et al. | 162/358 |

*Primary Examiner*—W. Gary Jones
*Assistant Examiner*—Brenda Lamb
*Attorney, Agent, or Firm*—Kane, Dalsimer, Sullivan, Kurucz, Levy, Eisele and Richard

[57] ABSTRACT

A suction pipe assembly for dewatering a web in a papermaking machine includes a rotating pipe supporting suction cover and attached to a frame by a bearing sleeve. Support members extend form the bearing sleeve to the pipe without obstructing the flow of air through the pipe.

14 Claims, 1 Drawing Sheet

SUPPORT APPARATUS FOR PAPERMAKING MACHINE ROTATING FELT SUCTION PIPES

BACKGROUND OF THE INVENTION a. Field of Invention

This invention pertains to a papermaking machine for making a continuous paper sheet from a wet paper web, and more particularly to a web conditioning assembly used for removing water and conditioning a felt used in said machine, said assembly including a suction chamber which is rotatable for easy cleaning or disassembly.

b. Description of the Prior Art

In papermaking or Fourdrinier machines, various means are used for removing water from a continuous wet paper web to obtain a paper sheet having a preselected water content, density, and other characteristics. For example, the wet paper web is contacted with a continuous felt and then the felt and the paper web are passed through a press nip and/or other means for removing water from the paper web and transferring it to the felt. After the web and felt are separated, the felt traverses one or more devices used for dewatering and conditioning the felt. Devices are known in the art, such as felt suction pipes or uhle boxes, which consist of an elongated pipe extending across the width of the felt. The pipe has a longitudinal, relatively narrow slot, usually defined by a cover secured to the pipe. At least one end of the pipe is in communication with a source of vacuum to produce suction through the slot, thereby extracting water from the felt. A lube shower may be mounted upstream of the pipe slot for wetting the felt before it traverses the slot for conditioning the felt. After a prolonged use, the felt may pick up foreign materials, including small segments of the paper web. These foreign materials are removed from the felt by the suction pipe, and may get lodged into the slot of the pipe requiring cleaning.

Economically it is more convenient to keep the machine line running without cleaning and reconditioning the felt for the short time period required to clean the suction slots. While this procedure may result in some of the paper sheet being discarded because it does not meet certain specifications, it is still cheaper in the long run then stopping the line altogether because the expensive and time consuming restarting of the machine is avoided. Various types of support arrangements were used in prior art papermaking machines to rotate suction pipes for cleaning. However, previous attempts for rotating the pipes were uneconomical because they used bearings which surround the pipe. Because of their size these bearings were expensive and it was hard to keep them sealed against the wet and hostile environment. Moreover, because of the size of the pipes and the bearings a large torque was required to turn the pipes.

OBJECTIVES AND SUMMARY OF THE INVENTION

In view of the above mentioned disadvantages of the prior art, it is an objective of the present invention to provide a web conditioning assembly which can be easily cleaned without stopping the movement of a paper web or felt, or impinging or impeding on the felt.

A further objective is to provide a web conditioning assembly which may be moved to disengage from the felt without applying any transversal forces on the felt, or producing any unnecessary wear and tear.

A further objective is to provide a web conditioning assembly which can be disassembled easily for repairs.

Yet another objective is to provide a suction pipe assembly with smaller and cheaper bearings, requiring a lower torque.

Other advantages of the invention shall become apparent from the following description of the invention. The term web as used herein refers to either a paper web, a felt, or both. A web conditioning assembly constructed in accordance with this invention comprises a stationary frame, a pipe mounted on said frame, said pipe being rotatable around a longitudinal axis, and a cover secured to the pipe for defining suction aperture means extending into the interior of said pipe. The cover is disposed in an arrangement on the pipe so that as the pipe is moved from a normal position in which the cover engages the web to a service position, the cover disengages from the felt without applying any transversal forces thereon. Thus, wear and tear on the web is eliminated.

DETAILED DESCRIPTION OF THE INVENTION

Figures 1, 2, 3, 4:
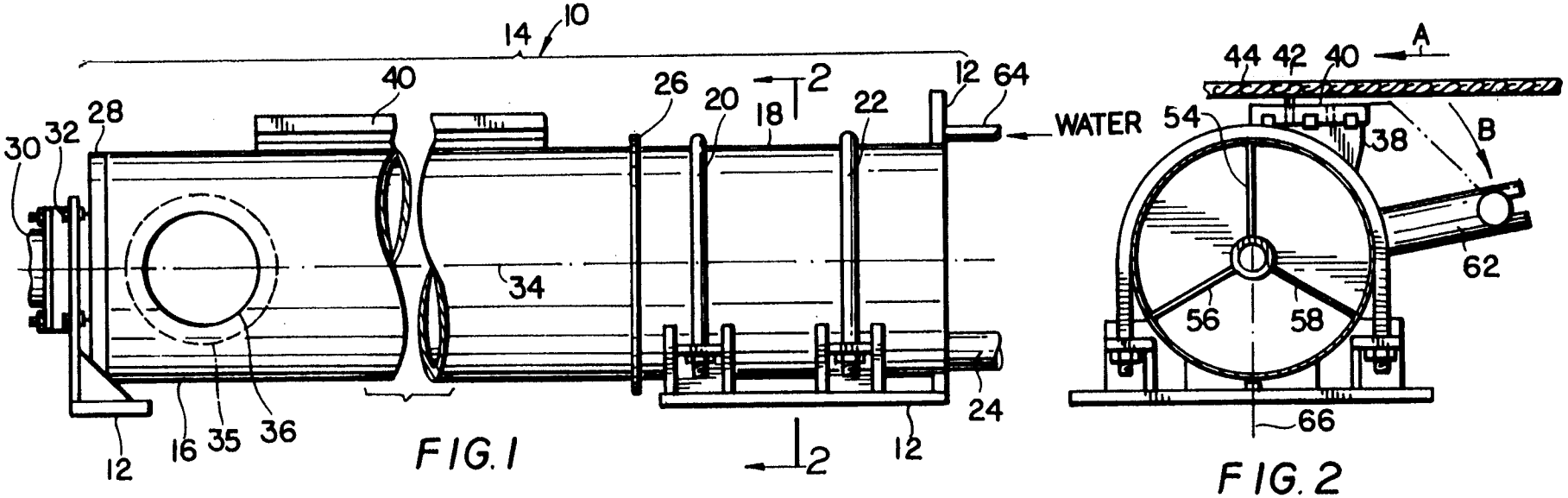
FIG. 1 shows a side-elevational view of a suction pipe constructed in accordance with this invention.
FIG. 2 shows a cross-sectional view of the pipe of FIG. 1 taken along line 2—2.
FIG. 3 shows a partial side elevational view of the rotating section interior of the pipe of FIG. 1.
FIG. 4 shows a partial side elevational view of the stationary section interior of the pipe of FIG. 1.

Referring now to the Figures, a suction pipe assembly 10 constructed in accordance with this invention includes a stationary frame 12 supporting a suction pipe 14. Suction pipe 14 consists of two axially spaced sections 16 and 18. Section 18 is stationary and is mounted on frame 12 by two U-shaped clamps 20, 22. Section 18 is closed off at one end and is connected to a vacuum source (not shown) through a pipe 24. Opposite to pipe 24, a sealing member 26 is disposed between the two sections 16, 18 to insure that air does not enter therebetween. Sealing member may be a ring made for example from neoprene or similar rubber-like material.

Opposite sealing member 26, pipe section 16 is closed off with an end plate 28. An axle 30 is mounted on plate 28 and extends away from the plate coaxially with pipe sections 16 and 18. Axle 30 is journaled in a bearing 32 also mounted on frame 12. Near end plate 28, section 16 is also provided with a cleanout hole 35 closed by a removable cap 36.

Mounted on pipe section 16 is a suction cover 38 having a horizontal surface 40. One or more of slots 42 are made in surface 40 which are in communication with the interior of the pipe section 16. Cover 38 is constructed and arranged to apply the vacuum from pipe 24 and pipe section 16 to a web 44 traveling across surface 40 in the direction indicated by arrow A (See FIG. 2). Because it must be able to resist wear and tear cover 38 may be made of a polyethylene or ceramic material.

As shown in more detail in FIG. 2, section 16 is mounted on a shaft 46 disposed along the longitudinal axis 34 near its end 49. Three vanes extending radially away from the shaft 46 to the interior surface of pipe 16 and support the pipe. Two of these vanes 48, 50 can be seen in FIG. 3. These vanes are made of sheet metal or other suitable material and are welded or otherwise secured to the shaft 46 and the interior surface of pipe section 16. Preferably the vanes are angularly spaced from each other at an angle of 120°.

As shown in FIGS. 2 and 4, the suction pipe also includes a sleeve 52 mounted co-axially within section 18. Coupled to the sleeve 52 are three vanes 54, 56 and 58 which are similar in shape and size to the vanes mounted on shaft 46. Vanes 54, 56, 58 are used to support sleeve 52. Sleeve 52 is formed with an axial aperture hole 60 constructed to receive the end 49 of shaft 46 in a sliding engagement (as shown in phantom lines in FIG. 4). The shaft end 49 and the sleeve 52 cooperate to form a sleeve bearing for supporting the pipe section 16 and at the same time allow it to rotate about axis 34. Section 16 may be rotated either manually by mounting a handle on shaft 30 or by applying a rotational force on the shaft 30 by a mechanical, hydraulic, pneumatic, electrical or other rotation means known in the art.

The suction pipe described above operates as follows. Normally the pipes section 16 is positioned to hold cover 38 in the horizontal position shown in FIG. 2. A web 44 runs across cover 38 in direction A. Vacuum from tube 24 is applied through the pipe sections 18, 16 and slots 42 to the web to remove water therefrom. If required, a shower head 62 may be installed upstream of the cover 40 to spray the web with water for conditioning. Water for the shower head 62 is provided by a water supply pipe 64 (FIG. 1). If the slots 42 in cover 38 become plugged and/or at regular intervals, the suction pipe assembly is serviced as follows. The vacuum through pipe 24 is discontinued and pipe section 16 is rotated by shaft 30 in direction B (FIG. 2) by about 90° with shaft 46 rotating with respect to sleeve 52 to thereby remove the cover surface 40 from contact with web 44. The slots 42 may now be cleaned by using air, water or other well known means. Importantly, the cover 38 is offset from the vertical axis 66 of sections 16, 18 so that the surface 40 can be rotated away from the web 44 without interfering with its movement. Thus the web can continue to move in direction A while the suction pipe is being serviced.

Pipe sections 16, 18 may be made to any dimension required. Typically they have a diameter in the range of 6–20" and can be up to 400" long. The vanes attached to shaft 46 or sleeve 52 may have a thickness of about 0.25" and a width (in the axial direction) of about 4".

The suction pipe assembly described above has several important advantages. The vanes, shaft 46 and sleeve 52 have a relatively small cross section and accordingly provide minimum air resistance and obstruction to vacuum during the dewatering operation. Moreover, the torque required to rotate the pipe is much lower than the torque required for pipes having large bearings surrounding the pipes.

Obviously numerous modifications may be made to this invention without departing from its scope as defined in the appended claims.

I claim:

1. A suction pipe assembly for dewatering a web in a papermaking machine comprising:

a frame;

a hollowing pipe extending along a longitudinal axis and having a first end rotatably mounted on said frame, a second end opposite said first end being fixedly mounted on said frame, and suction means for applying suction to said web;

a shaft disposed in said hollow pipe;

support means mounted on said shaft for supporting said pipe on said shaft;

vacuum supply means for applying vacuum to said pipe; and bearing means for rotatably supporting said pipe on said frame near said first end.

2. The assembly of claim 1 further comprising sealing means for vacuum sealing said second end.

3. The assembly of claim 1 wherein said bearing means includes a sleeve and said shaft includes a shaft end slidably engaging said sleeve.

4. The assembly of claim 1 wherein said pipe includes rotating means for selectively rotating said pipe.

5. A suction pipe assembly for dewatering a web used in papermaking, said assembly comprising;

a frame;

a fixed pipe section mounted on said frame;

a rotating pipe section rotatably supported by said frame, said fixed and rotating pipe section having a common longitudinal axis and being disposed in an axially spaced relationship;

each said pipe section having a closed end supported by said frame and facing open ends opposite said closed ends;

sealing means for sealing said open ends;

pipe support means disposed at said open ends to support said pipe sections;

suction means supported by said rotating pipe for applying suction to said web;

vacuum supply means for applying a vacuum to said pipe section; and whereby said rotating pipe section is selectively rotated with respect to said frame for cleaning.

6. The assembly of claim 5 wherein said pipe support means includes a rotating bearing.

7. The assembly of claim 5 wherein pipe support means includes a shaft extending coaxially with said longitudinal axis in one of said rotating and fixed pipe sections, and a sleeve extending coaxially with said longitudinal axis in the other of said fixed and rotating pipe sections, said shaft and sleeve cooperating to form a sleeve bearing.

8. The assembly of claim 7 wherein said support means further includes a member extending from at least one of said sleeve and said shaft to one of said rotating and fixed pipe sections.

9. A suction pipe assembly for dewatering a web used in papermaking, said assembly comprising;

a frame;

a fixed pipe section mounted on said frame;

a rotating pipe section rotatably supported by said frame, said fixed and rotating pipe section having a common longitudinal axis and being disposed in an axially spaced relationship;

each said pipes having a closed end closed to the atmosphere supported by said frame and facing open ends opposite said closed ends and an elongated member extending coaxially with said longitudinal axis;

sealing means for sealing said open ends;

pipe support means disposed at said open ends and extending from said elongated member to an inner surface of said pipe sections said pipes;

bearing means for rotatably coupling said elongated members;

suction means supported by said rotating pipe for applying suction to said web;

vacuum supply means for applying a vacuum to said pipe section; and whereby said rotating pipe is selectively rotated with respect to said frame for cleaning.

10. The assembly of claim 9 wherein one of said elongated members includes a shaft disposed coaxially with said longitudinal axis in one of said rotating and fixed pipe sections, and the other of said elongated members includes a sleeve disposed coaxially with said longitudinal axis in the other of said fixed and rotating pipe sections, said shaft and sleeve cooperating to form a sleeve bearing.

11. The assembly of claim 10 wherein said support members include vanes extending radially from said shaft and sleeve to one of said pipe sections.

12. The assembly of claim 9 further comprising rotating means attached to the closed end of said rotating pipe section for selective rotation.

13. The assembly of claim 9 wherein suction means includes a cover and a plurality of slots extending from said cover to the interior of said rotating pipe section.

14. The assembly of claim 13 wherein said rotating pipe section has a vertical axis and said cover is offset from said vertical axis.

* * * * *